US012704310B2

(12) United States Patent
Ma et al.

(10) Patent No.: US 12,704,310 B2
(45) Date of Patent: Aug. 11, 2026

(54) REFRIGERATOR HAVING EVAPORATOR DISPOSED AT BOTTOM OF REFRIGERATOR BODY

(71) Applicants: QINGDAO HAIER REFRIGERATOR CO., LTD., Qingdao (CN); HAIER SMART HOME CO., LTD., Qingdao (CN)

(72) Inventors: Jian Ma, Qingdao (CN); Shaoyi Wang, Qingdao (CN); Jianquan Chen, Qingdao (CN); Dongqiang Cao, Qingdao (CN); Jianru Liu, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 170 days.

(21) Appl. No.: 18/019,886

(22) PCT Filed: Aug. 4, 2021

(86) PCT No.: PCT/CN2021/110593
§ 371 (c)(1),
(2) Date: Feb. 6, 2023

(87) PCT Pub. No.: WO2022/037411
PCT Pub. Date: Feb. 24, 2022

(65) Prior Publication Data

US 2023/0272964 A1 Aug. 31, 2023

(30) Foreign Application Priority Data

Aug. 18, 2020 (CN) ..... 202010833967.3

(51) Int. Cl.
*F25D 23/00* (2006.01)
*F25B 39/02* (2006.01)

(52) U.S. Cl.
CPC ..... *F25D 23/006* (2013.01); *F25B 39/02* (2013.01)

(58) Field of Classification Search
CPC ..... F25D 23/006; F25B 39/02
See application file for complete search history.

(56) References Cited

U.S. PATENT DOCUMENTS 2,767,558 A 10/1956 Wallenbrock
2,994,207 A 8/1961 Preotle
(Continued)

FOREIGN PATENT DOCUMENTS

CN 1611876 A 5/2005
CN 208688069 U 4/2019
(Continued)

OTHER PUBLICATIONS

Wang et al. (CN110375504A), English Translation, Refrigerator with drainage mechanism, 2019, Whole document (Year: 2019).*
(Continued)

*Primary Examiner* — Jerry-Daryl Fletcher
*Assistant Examiner* — Keith Stanley Myers
(74) *Attorney, Agent, or Firm* — troutman pepper locke; Tim Tingkang Xia, Esq.

(57) ABSTRACT

Provided is a refrigerator having an evaporator disposed at the bottom of a refrigerator body. The refrigerator comprises: the refrigerator body having a bottom inner liner, the bottom inner liner defining a cooling compartment and a storage space, and the cooling compartment being disposed below the storage space; and the evaporator generally in the shape of a flat cuboid, arranged in the cooling component, and placed inclinedly along the depth direction of the
(Continued)

refrigerator with respect to the horizontal direction, the direction of inclination being upward from front to back. By placing the evaporator inclinedly, the space utilization is improved, and an air path is further improved so that an airflow can flow more uniformly and smoothly throughout an air return process and the air circulation efficiency is improved.

12 Claims, 6 Drawing Sheets

(56) References Cited

U.S. PATENT DOCUMENTS

| | | | | |
|---|---|---|---|---|
| 4,513,586 | A * | 4/1985 | Jennings | F24F 1/36 62/297 |
| 9,754,574 | B2 * | 9/2017 | Kopko | F25B 49/025 |
| 2011/0179817 | A1 * | 7/2011 | Andersson | F25D 19/00 62/288 |
| 2019/0142185 | A1 | 5/2019 | Bates et al. | |

FOREIGN PATENT DOCUMENTS

| | | | |
|---|---|---|---|
| CN | 208688080 | U | 4/2019 |
| CN | 208817806 | U | 5/2019 |
| CN | 110285629 | A | 9/2019 |
| CN | 110375474 | A | 10/2019 |
| CN | 110375491 | A | 10/2019 |
| CN | 110375504 | A | 10/2019 |
| CN | 209893729 | U | 1/2020 |
| CN | 211147012 | U | 7/2020 |

OTHER PUBLICATIONS

Ding et al. (CN211147012U), English Translation, Air-cooled horizontal freezer, 2020, Whole document (Year: 2018).*

JPO, "Office Action for JP Application No. 2023-511899", Japan.

EPO, "Supplementary European Search Report for EP Application No. 21857506.6", Hague, Germany, Oct. 25, 2023.

Au, "Examination Report for AU Application No. 2021326859", Australia.

JPO, "Decision to Grant for JP Application No. 2023-511899", Japan.

EPO, "Office Action for EP Application No. 21857506.6".

Chinese Intellectual Property Office (ISR/CN), "International Search Report for PCT/CN2021/110593", China, Nov. 4, 2021.

SIPO, "1st CN Office Action and Search Report for CN Application No. 202010833967.3", China.

SIPO, "2nd CN Office Action and Search Report for CN Application No. 202010833967.3", China.

* cited by examiner

A-A

REFRIGERATOR HAVING EVAPORATOR DISPOSED AT BOTTOM OF REFRIGERATOR BODY

CROSS-REFERENCE TO RELATED PATENT APPLICATION

This application is a U.S. national stage application of PCT Patent Application No. PCT/CN2021/110593 filed Aug. 4, 2021, which claims priority to and the benefit of Chinese Application No. 202010833967.3 filed Aug. 18, 2020, which are incorporated herein in their entireties by reference.

FIELD OF THE INVENTION

The present invention relates to the technical field of household appliances, and particularly relates to a refrigerator having an evaporator disposed at the bottom of a refrigerator body.

BACKGROUND OF THE INVENTION

Some refrigerator users have relatively high requirements on the space occupation of refrigerators. Refrigerators need to provide an available volume as large as possible while occupying less space. In a conventional refrigerator, an evaporator is disposed at a back portion of the refrigerator and occupies a large depth space, so it cannot meet the requirements of an ultra-thin refrigerator body. For the above problems, a refrigerator having an evaporator at the bottom appears in the prior art.

However, in a refrigerator having a transversely disposed evaporator in the prior art, the evaporator is horizontally placed, which has various defects. Since the evaporator is transversely disposed at the bottom of the refrigerator, most of the bottom space of the refrigerator is occupied, the space utilization of the refrigerator is reduced. A horizontal arrangement method causes vortex to exist around the evaporator, leading to poor circulative performance of an air path. Defrosting water of the evaporator may also be easily accumulated on the surface of the evaporator, causing evaporator frosting or even freezing.

BRIEF DESCRIPTION OF THE INVENTION

An objective of the present invention is to provide a refrigerator having an evaporator disposed at the bottom of a refrigerator body capable of at least solving any one of the above problems.

A further objective of the present invention is to improve the space utilization of the refrigerator.

Another further objective of the present invention is to improve an air path.

Particularly, the present invention provides a refrigerator having an evaporator disposed at the bottom of a refrigerator body, including: the refrigerator body having a bottom inner liner, the bottom inner liner defining a cooling compartment and a storage space, and the cooling compartment being disposed below the storage space; and the evaporator arranged in the cooling component and placed inclinedly along the depth direction of the refrigerator with respect to the horizontal direction, with the direction of inclination being upward from front to back.

Further, an inclination angle of the evaporator with respect to the horizontal direction ranges from 7.0° to 8.0°.

Further, the evaporator is generally in the shape of a flat cuboid, and a proportion of a distance between a front side surface and a rear side surface of the evaporator to a distance between a top surface and a bottom surface of the evaporator ranges from 1.9 to 2.1.

Further, the distance between the front side surface and the rear side surface of the evaporator ranges from 150 mm to 155 mm; and the distance between the top surface and the bottom surface of the evaporator ranges from 73 mm to 78 mm.

Further, a bottom wall of the bottom inner liner includes: a first inclination portion disposed inclinedly downward from a front end of the bottom wall of the bottom inner liner from front to back; a recessed portion disposed at a rear side of the first inclination portion and configured to be inclined upward from a transverse middle to two sides to form a drain hole in the transverse middle, the drain hole being configured to drain water from the cooling compartment; and a second inclination portion disposed inclinedly upward from a rear end of the lower recessed portion from front to back and configured to support the evaporator, a front end of the evaporator abutting against the first inclination portion so that water on the evaporator is gathered at the recessed portion, and a position of the drain hole along the front and rear direction of the refrigerator body is at a front portion of the evaporator.

Further, the bottom wall of the bottom inner liner further includes: a third inclination portion disposed inclinedly upward from a rear end of the second inclination portion from front to back and having an inclination angle greater than that of the second inclination portion. The refrigerator further includes: a refrigeration fan disposed on the third inclination portion and configured to promote formation of a refrigeration airflow sent to the storage space via the evaporator; and an air supply duct disposed at a downstream of an air supply direction of the refrigeration fan and configured to convey the refrigeration airflow to the storage space.

Further, the refrigeration fan is a centrifugal fan, the centrifugal fan includes a volute and an impeller disposed in the volute, the volute is fixed to the third inclination portion, and a suction inlet of the volute faces a front upper side to suck air undergone heat exchange through the evaporator by utilizing the impeller; and an exhaust outlet of the volute is located at a rear side, and the air supply duct is connected with the exhaust outlet, extends upward and is configured to upward guide the refrigeration airflow to the storage space.

Further, the refrigerator body further includes: an evaporator upper cover transversely disposed in the bottom inner liner and used to separate the cooling compartment from the storage space. The evaporator upper cover includes: a first upper cover portion located at the top of the evaporator and basically horizontally disposed; and a second upper cover portion extending inclinedly upward from a rear end of the first upper cover portion and disposed in a manner of being parallel to the centrifugal fan and forming a set distance from the centrifugal fan. Air sucked by the centrifugal fan enters the suction inlet through a gap between the centrifugal fan and the second upper cover portion.

Further, a space between the centrifugal fan and the second upper cover portion is smaller than or equal to 30 mm.

Further, an inclination angle of the third inclination portion with respect to the horizontal direction ranges from 36.0° to 37.0°.

The evaporator of the refrigerator of the present invention is inclinedly disposed along the depth direction of the refrigerator with respect to the horizontal direction, which breaks through the technical constraint that an evaporator needs to be horizontally placed to reduce a depth size in the prior art, and improves the space utilization. Although a length in the front and rear direction may be increased due to inclined placement of the evaporator in the shape of a flat cuboid, the arrangement of other components in the cooling compartment is more reasonable through the inclined placement of the evaporator. Through practical airflow flow field analysis, it is proved that the air path is improved, the airflow can flow more smoothly and uniformly throughout an air return process, and the air circulation efficiency is higher.

Further, in the refrigerator of the present invention, the evaporator is in inclined arrangement, so that defrosting water of the evaporator can more easily flow to the drain hole, and the water drainage is smoother.

The above and other objectives, advantages and features of the present invention will become more apparent to those skilled in the art from the following detailed description of specific embodiments of the present invention in conjunction with the accompanying drawings.

BRIEF DESCRIPTION OF THE DRAWINGS

Some specific embodiments of the present invention are described in detail below with reference to the drawings by way of example and not limitation. The same reference numerals in the drawings indicate the same or similar components or parts. Those skilled in the art should understand that these drawings are not necessarily drawn to scale. In the drawings.

DETAILED DESCRIPTION

Figure 1:
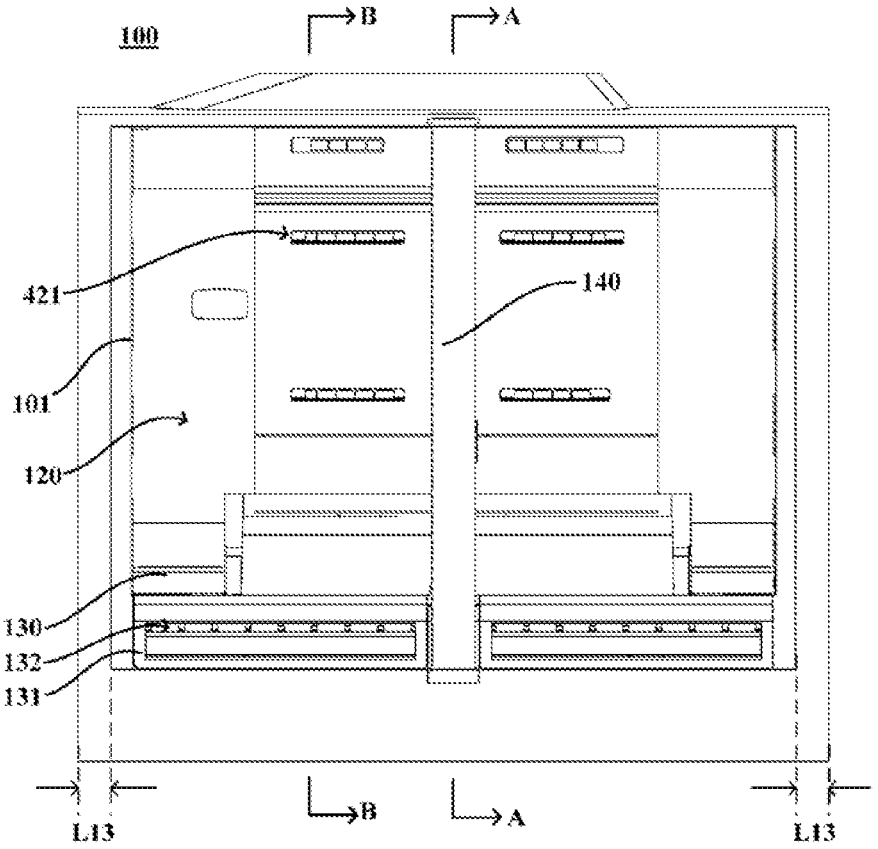
FIG. 1 is a schematic front view of a refrigerator body in a refrigerator according to an embodiment of the present invention.

In the description of the present embodiment, it is to be understood that the orientations or position relationships indicated by the terms "longitudinal," "transverse," "length," "width," "thickness," "upper," "lower," "front," "rear," "left," "right," "vertical," "horizontal," "top," "bottom," "depth," etc. are based on the orientation of the refrigerator in the normal use state as a reference, and may be determined with reference to the orientations or position relationships shown in the drawings, for example, "front" indicating the orientation refers to a side of the refrigerator facing a user. This is merely to facilitate a description of the present invention and to simplify the description, and is not to indicate or imply that the devices or elements referred to must have a particular orientation, or be constructed and operated in a particular orientation, and therefore should not be construed as limiting the present invention.

Figure 2:
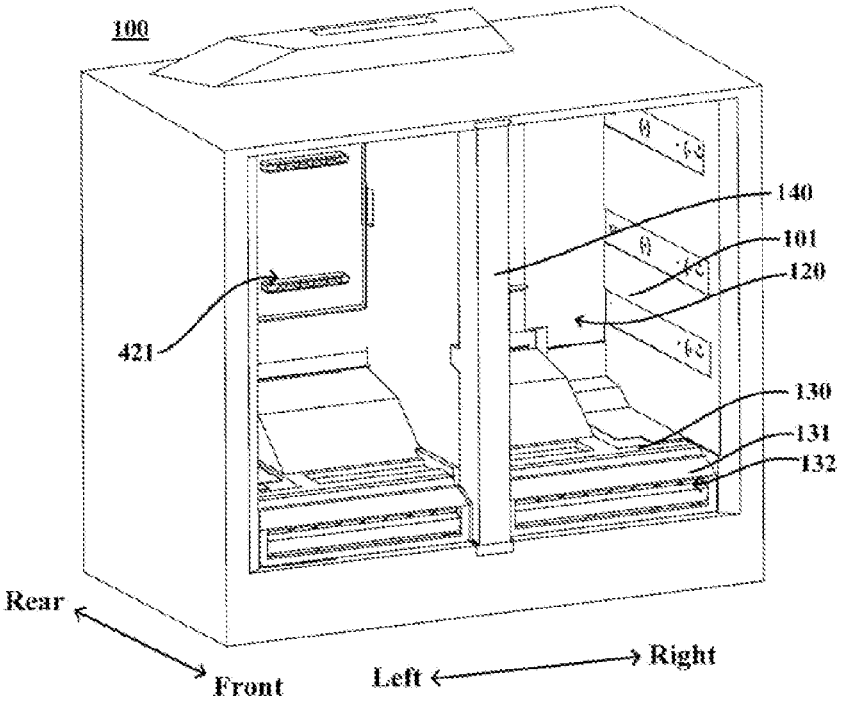
FIG. 2 is a schematic stereogram of the refrigerator body shown in FIG. 1.

FIG. 1 is a schematic front view of a refrigerator body 100 in a refrigerator according to an embodiment of the present invention. FIG. 2 is a schematic stereogram of the refrigerator body 100 shown in FIG. 1. FIG. 1 and FIG. 2 mainly show a structure of a bottom of the refrigerator body 100.

The refrigerator according to the present embodiment generally may include the refrigerator body 100. The refrigerator body 100 may include a casing, an inner liner, a heat insulation layer and other accessories. The casing is an outer layer structure of the refrigerator, and protects the whole refrigerator. In order to isolate heat conduction with the outside, the heat insulation layer is added between the casing and the inner liner of the refrigerator body 100, and the heat insulation layer is generally formed through a foaming process. There may be one or multiple inner liners. For example, the inner liner may be divided into a refrigerating inner liner, a variable-temperature inner liner, a freezing inner liner, etc.

A plurality of inner liners may be vertically arranged and disposed. In the present embodiment, a bottom inner liner 101 defines a cooling compartment 110 and a storage space 120, and the cooling compartment 110 is disposed below the storage space 120. The storage space 120 may be a space for storage at the very bottom of the refrigerator. Generally, the bottom inner liner 101 is a freezing inner liner, and the storage space 120 forms a freezing compartment. A variable-temperature compartment defined in the variable-temperature inner liner, a refrigerating compartment defined in the refrigerating inner liner, etc. may be disposed above the freezing compartment according to requirements. The quantities and functions of specific storage compartments may be set according to the requirements of the refrigerator. Components in the bottom inner liner 101 are most complicated and have highest requirements on sizes, integral sizes of other inner liners can be correspondingly set according to the size of the bottom inner liner 101. A door body is also disposed at the front side of the refrigerator body 100, to open or close the storage compartments. In order to show an inside structure of the refrigerator body 100, the door body is not shown in the figures.

In the refrigerator of the present embodiment, a ratio of a volume of the storage space 120 to an integral volume of the refrigerator body 100 is set to be greater than or equal to 17.9%, for example, is set to be 17.9% to improve the space utilization efficiency of the storage space 120. In a preferred embodiment, the volume of the refrigerator body 100 may be set to be 992.2 dm3, the volume of the storage space 120 is 178 L, and the ratio of the volume of the storage space 120 to the integral volume of the refrigerator body 100 is 17.9%. Through the above arrangement, the effective utilization rate of the storage space 120 is improved under the condition of ensuring the space occupation of the refrigerator body 100. The ratio of the volume of the storage space 120 to the integral volume of the refrigerator body 100 is set through structure optimization made according to space requirements and refrigeration performance requirements, and the effect is verified through trial products. Under the condition of reducing the size of the refrigerator body, the volume of the storage space 120 can be enabled not to change, and the volume requirements of the freezing compartment are met.

An evaporator upper cover 130 and a longitudinal separation plate 140 may be disposed in the bottom inner liner 101. The evaporator upper cover 130 is transversely disposed in the bottom inner liner 101 and configured to separate the cooling compartment from the storage space 120. The evaporator upper cover 130 is used as a bottom wall of the storage space 120 and the top of the cooling compartment at the same time, and the storage space 120 above the evaporator upper cover is used for article storage.

A compressor compartment 150 is formed under the cooling compartment 110, and is configured to install a compressor and a condenser of the refrigerator. A front portion of a compressor compartment top cover 151 is parallel to a third inclination portion 1013, and the flowability of a foaming layer is improved. Additionally, the compressor compartment top cover 151 is disposed with an interval from the bottom wall of the bottom inner liner 101. The parallel space from the front portion of the compressor compartment top cover 151 to the third inclination portion 1013 may be set to be smaller than or equal to 45 mm, for example, may be set to be 45 mm. The parallel space from the front portion of the compressor compartment top cover 151 to the third inclination portion 1013 is set through structure optimization made according to space performance requirements, and the effect is verified through trial products.

A foaming layer is disposed at the outer side of the bottom inner liner 101. A thickness of the foaming layer at two sides of the bottom inner liner 101 is set to be smaller than or equal to 65 mm. An integral width of the refrigerator body 100 is 905 mm. After the thickness of the foaming layer is reduced, the volume of the storage space 120 may be increased. There is a conflict between the thickness of the foaming layer and the heat insulation performance. The reduction of the thickness of the foaming layer to 65 mm is set through structure optimization made according to space requirements and heat insulation performance requirements, and the effect is verified through trial products.

A foaming layer may also be disposed between the compressor compartment top cover 151 and the bottom inner liner 101, to prevent heat of the compressor compartment 150 from affecting the freezing of the storage space 120. Due to the limitation of the space between the compressor compartment top cover 151 and the third inclination portion 1013, the thickness of the foaming layer at two sides of the bottom inner liner 101 is smaller than or equal to 45 mm. This is set through structure optimization made according to space requirements and heat insulation performance requirements, and the effect is verified through trial products.

The longitudinal separation plate 140 is disposed in the middle of the storage space 120, and separates the storage space 120 into two transversely arranged storage cavities. That is, the storage space 120 is provided with a left storage cavity and a right storage cavity, and each of the two storage cavities may be respectively provided with a door body to form a double-door structure.

Figure 3:
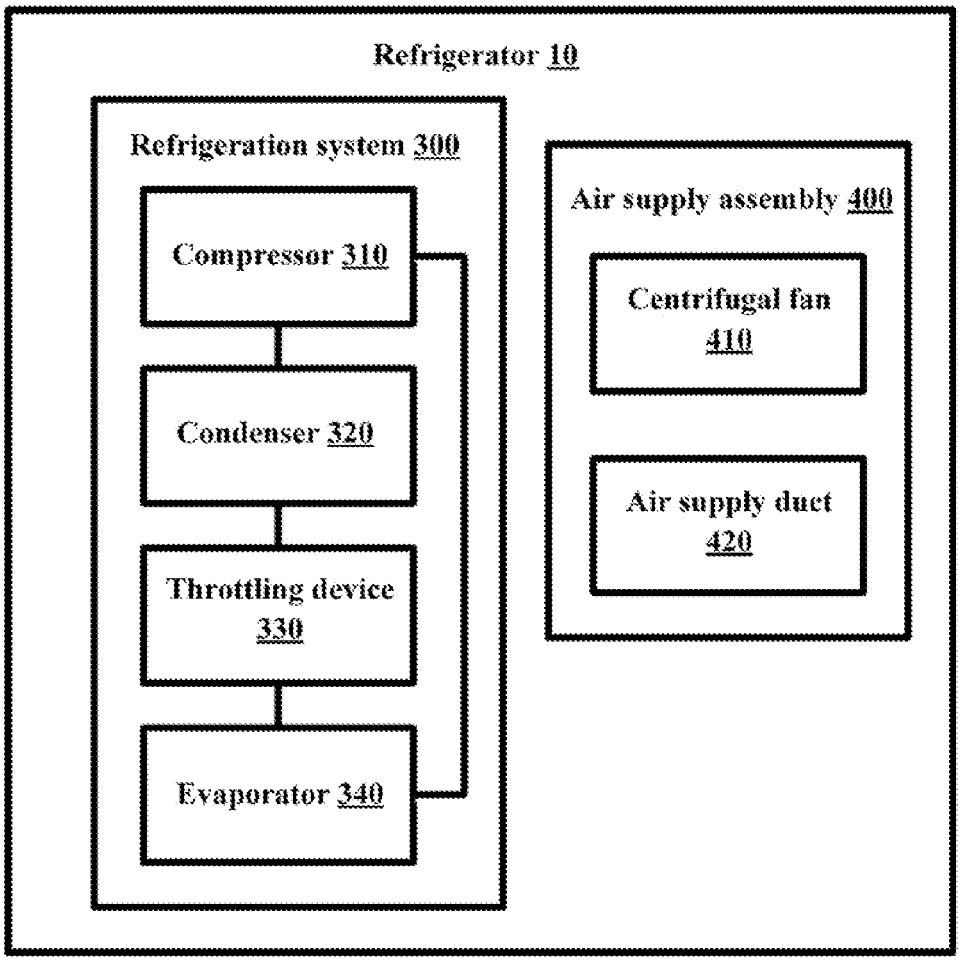
FIG. 3 is a schematic block diagram of a refrigerator according to an embodiment of the present invention.

FIG. 3 is a schematic block diagram of a refrigerator according to an embodiment of the present invention. A refrigeration system 300 may be a refrigeration circulation system composed of a compressor 310, a condenser 320, a throttling device 330, an evaporator 340, etc. The evaporator 340 is configured to provide cold directly or indirectly into the storage space 120. The refrigerator realizes circulation of a refrigeration airflow between the evaporator 340 and the storage compartment through an air duct system. Since a circulation structure and a working principle of the refrigeration system are well known and can be easily realized by those skilled in the art, the refrigeration system is not illustrated in detail below in order not to obscure the inventive aspects of the present application.

An air supply assembly 400 is configured to form airflow circulation between the cooling compartment and the storage space 120, and may specifically include a refrigeration fan 410 and an air supply duct 420.

In order to meet the refrigeration requirement of the refrigerator, a rated refrigeration power or a maximum refrigeration power of the refrigeration system according to the present embodiment is set to be not lower than 150 W. That is, the refrigeration capacity of the refrigeration system is not lower than 150 W.

Figure 4:
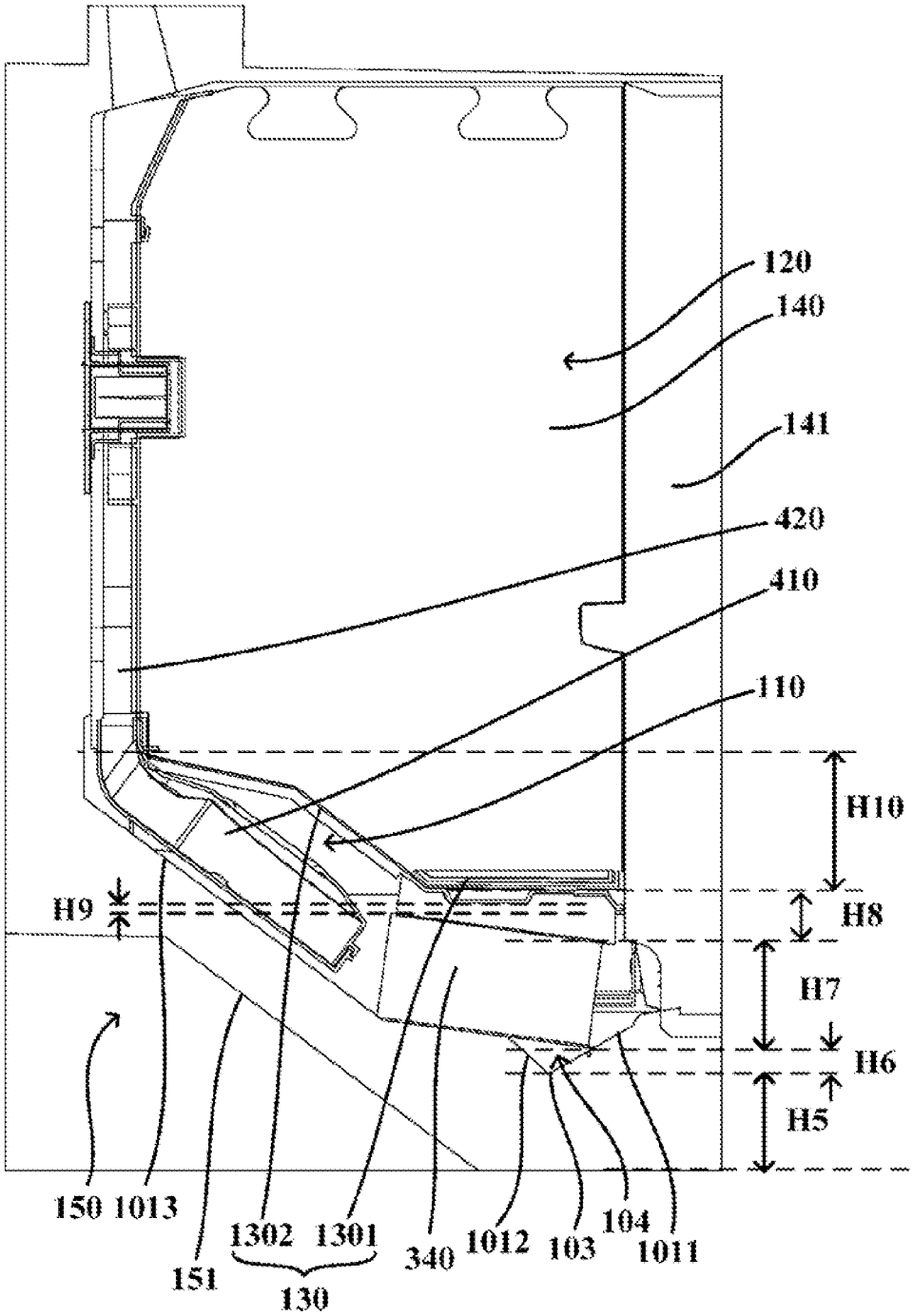
FIG. 4 is a schematic section view along a cutting plane line A-A in FIG. 1, and shows a longitudinal size of each component.
Figure 5:
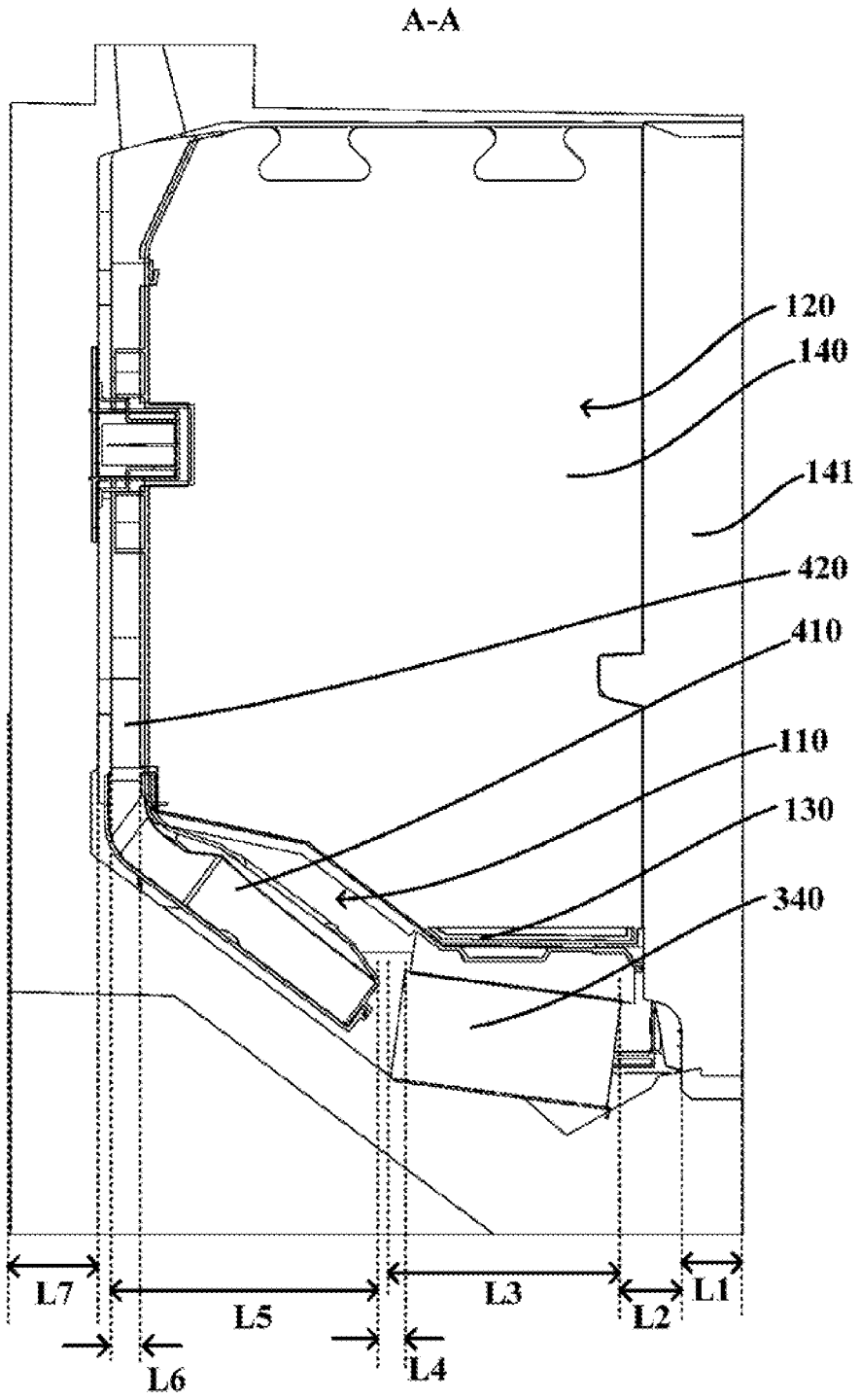
FIG. 5 is also a schematic section view along a cutting plane line A-A in FIG. 1, and shows a depth size of each component in a front and rear direction.
Figure 6:
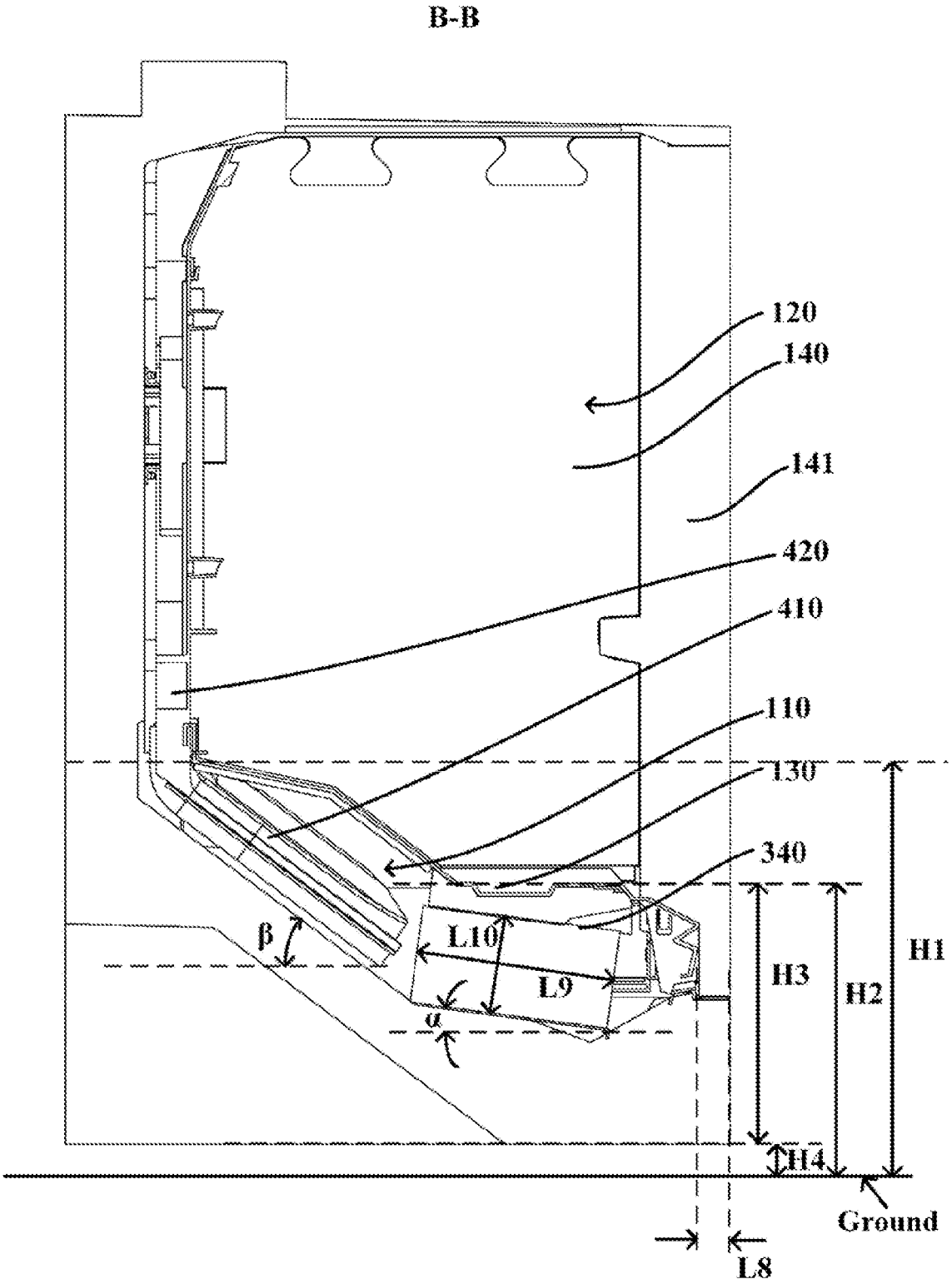
FIG. 6 is a schematic section view along a cutting plane line B-B in FIG. 1.
Figure 7:
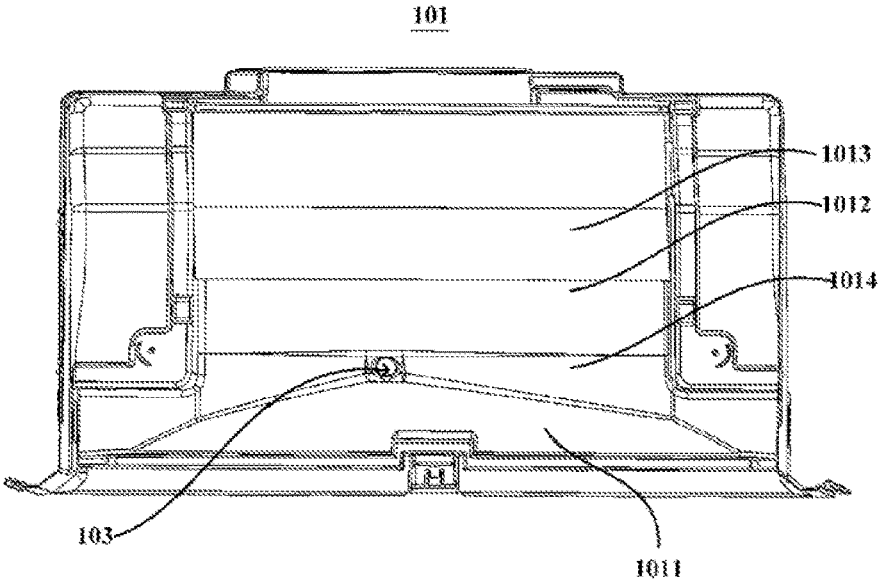
FIG. 7 is a schematic diagram of a longitudinal section at a lower portion of a refrigerator body in a refrigerator according to an embodiment of the present invention.

FIG. 4 is a schematic section view along a cutting plane line A-A in FIG. 1, and shows a longitudinal size of each component. FIG. 5 is also a schematic section view along a cutting plane line A-A in FIG. 1, and shows a depth size of each component in a front and rear direction. FIG. 6 is a schematic section view along a cutting plane line B-B in FIG. 1. FIG. 7 is a schematic diagram of a longitudinal section at a lower portion of a refrigerator body in a refrigerator according to an embodiment of the present invention. In order to conveniently show specific components, cutting plane lines are omitted in FIG. 4, FIG. 5 and FIG. 6, and only component profiles remain.

The cooling compartment 110 is disposed below the storage space 120, and is configured to install the evaporator 340 and a part of air supply assembly 400. Compared with a refrigerator having an evaporator 340 disposed at a rear portion of the refrigerator body, the refrigerator according to the present embodiment has the evaporator 340 disposed in the cooling compartment 110. On one hand, the depth size (a distance in the front and rear direction) of the refrigerator body 100 is reduced, and the depth size is possibly used for the storage space 120; and on the other hand, the bottom of the storage space 120 is heightened, so that the use inconvenience caused by the article taking and placement operation performed with the need of large bending or squatting of a user is avoided.

The depth size of the refrigerator body 100 of the refrigerator according to the present embodiment along the front and rear direction is set to be smaller than or equal to 510 mm. Through much structure optimization work, the refrigerator according to the present embodiment realizes the arrangement of the evaporator 340 of the refrigeration system with the rated refrigeration power or maximum refrigeration power not lower than 150 W in the cooling compartment 110 under the condition that the depth size is smaller than or equal to 510 mm, and thus the normal operation and energy consumption standard requirements of the refrigerator are met.

The evaporator 340 is generally in the shape of a flat cuboid. That is, a thickness size of the evaporator 340 vertical to a support surface is obviously smaller than a length size of the evaporator 340. The evaporator 340 may be a finned evaporator, and an arrangement direction of fins is parallel to the front and rear depth direction to facilitate an airflow to pass from front to back. In the present embodiment, the evaporator 340 may also be set to present other shapes according to requirements under the condition of meeting space requirements. The evaporator 340 in the shape of a flat cuboid is an implementation with a relatively compact and simple structure.

According to a refrigerator having an evaporator disposed at the bottom in the prior art, the evaporator is horizontally placed, and when an airflow enters a cooling compartment, it is easily gathered at a front end of the evaporator and cannot smoothly enter the evaporator to realize heat exchange. Additionally, an air suction space at an upper portion of a centrifugal fan is small, the airflow after the heat exchange cannot sufficiently enter the fan, and thus the air return efficiency is reduced. Airflow gathering also easily occurs under the condition that a connecting portion of an exhaust direction of the centrifugal fan and the air duct is too narrow, the airflow cannot be sufficiently blown into the air duct, and the air return and refrigeration efficiency is reduced.

According to the refrigerator of the present embodiment, the evaporator 340 is generally in the shape of a flat cuboid, and is inclinedly disposed in the cooling compartment 110, which breaks through the technical constraint that the evaporator 340 needs to be horizontally placed to reduce a depth size in the prior art. An inclination angle α of the evaporator 340 with respect to the horizontal direction ranges from 7.0° to 8.0°, for example, may be set to be 7.2°, 7.5° or 7.8°, and is preferably set to be 7.5°. Although the length increase in the front and rear direction may be caused by inclined placement of the evaporator 340 in the shape of a flat cuboid, the arrangement of other components in the cooling compartment 110 is more reasonable through the inclined placement of the evaporator 340. Additionally, through practical airflow flow field analysis, it is proved that the air circulation efficiency is higher, and the water drainage is smoother. A layout of inclined placement of the evaporator 340 is one of main technical improvements of the present embodiment. A distance between a front side surface and a rear side surface of the evaporator 340 ranges from 150 mm to 155 mm, for example, may be set to be 152 mm, 153 mm or 154 mm, and is preferably set to be 152 mm. A distance between a top surface and a bottom surface of the evaporator 340 ranges from 73 mm to 78 mm, for example, may be set to be 74 mm, 75 mm or 76 mm, and may be preferably set to be 75 mm. A proportion of the distance between the front side surface and the rear side surface of the evaporator 340 to the distance between the top surface and the bottom surface of the evaporator 340 ranges from 1.9 to 2.1, for example, may be set to be 1.95, 2.0 or 2.05, and is preferably set to be 2.0. Due to inclined placement of the evaporator 340, a hollow groove 104 configured to collect condensed water is formed under the evaporator 340. After entering the cooling compartment 110, the airflow may enter the evaporator 340 from the front side surface of the evaporator 340 to perform heat exchange, and a part of the airflow may also enter the evaporator 340 through two parts including the upper portion of the evaporator 340 and the bottom hollow groove 104 to perform heat exchange, so that the heat exchange is more uniform. Then, the airflow is sent to the air supply duct 420 through the refrigeration fan 410 to refrigerate the storage space 120 at the upper portion.

In order to reduce the depth size in the front and rear direction, the positions and sizes of each component in the cooling compartment 110 of the refrigerator of the present embodiment in the front and rear direction are strictly set. A proportion of a length of the horizontal direction projection of the evaporator 340 along the front and rear direction to a depth size of the refrigerator body 100 along the front and rear direction is lower than 30%, and for example, may be set to be 29.8%. The depth size of the refrigerator body 100 along the front and rear direction refers to a whole horizontal length from a front end to a rear end. The size and arrangement manner of the evaporator 340 are set through structure optimization made according to space requirements and refrigeration performance requirements, and the effect is verified through trial products.

The bottom wall of the bottom inner liner 101 further includes a first inclination portion 1011, a second inclination portion 1012, the third inclination portion 1013 and a recessed portion 1014.

The first inclination portion 1011 is disposed inclinedly downward from a front end of the bottom wall of the bottom inner liner 101 from front to back. The recessed portion 1014 is disposed at a rear side of the first inclination portion 1011 and is configured to be inclined upward from a transverse middle to two sides to form a drain hole 103 in the transverse middle. The drain hole 103 is configured to drain water from the cooling compartment 110. The position of the drain hole 103 is generally in a region of the transverse middle portion, but is not strictly required to be in a region of a transverse center. In some embodiments, the drain hole 103 may be located in a position properly near one side in the transverse middle portion.

The second inclination portion 1012 is disposed inclinedly upward from a rear end of the recessed portion 1014 from front to back and is configured to support the evaporator 340. Additionally, a front end of the evaporator 340 abuts against the first inclination portion 1011. The evaporator 340 is disposed on the second inclination portion 1012, so that water on the evaporator 340 is gathered at the recessed portion 1014, and a position of the drain hole 103 along the front and rear direction of the refrigerator body is at a front portion of the evaporator 340. An inclination angle of the evaporator 340 keeps consistent with an inclination angle of the second inclination portion 1012 with respect to the horizontal plane, the inclination angle α ranges from 7.0° to 8.0°, for example, may be set to be 7.2°, 7.5° or 7.8°, and may be preferably set to be 7.5°. That is, the recessed portion 1014 provided with the drain hole 103 is formed in a connecting position of the first inclination portion 1011 and the second inclination portion 1012, so that the drain hole 103 is used to drain condensed water of the evaporator 340. A height of the drain hole 103 with respect to the bottom surface of the refrigerator body 100 may be set to be smaller than or equal to 66 mm, and for example, may be set to be 66 mm. A height from the position of the evaporator 340 abutted against the first inclination portion 1011 to the drain hole 103 may be set to be smaller than or equal to 22 mm, and for example, may be set to be 22 mm. The height of the drain hole 103 is reduced to the lowest on the premise of ensuring a water drainage angle. The setting of the height of the drain hole 103 with respect to the bottom surface of the refrigerator body 100 and the height from the position of the evaporator 340 abutted against the first inclination portion 1011 to the drain hole 103 is performed through structure optimization made according to water drain performance requirements and space requirements, and the effect is verified through trial products.

The third inclination portion 1013 is disposed inclinedly upward from the second inclination portion 1012 from front to back and has an inclination angle greater than that of the second inclination portion 1012. The inclination angle of the third inclination portion 1013 with respect to the horizontal direction ranges from 36.0° to 37.0°, for example, may be set to be 36.5°, 37.6° or 36.9°, and is preferably 36.7°.

An inclination angle of the recessed portion 1014 is greater than or equal to 3°, and further, may be greater than or equal to 6°, for example. The inclination angle of the second inclination portion 1012 and the inclination angle of the third inclination portion 1013 are also respectively the inclination angle of the evaporator 340 and the inclination angle of the refrigeration fan 410. The inclination angle of the recessed portion 1014 can ensure that water is gathered to the drain hole 103.

The inclination angle of two sides of the recessed portion 1014 may be greater than or equal to 3° (preferably 7°), so that the water at the two sides is gathered to the drain hole 103. Through a structure of the recessed portion 1014, the space from the evaporator 340 to the bottom wall of the bottom inner liner 101 may be reduced as much as possible, so that heat can be transferred to the recessed portion 1014 through a heating wire (not shown in the figures) of the evaporator 340, to enable defrosting water to effectively flow to the drain hole 103. According to the structure of the recessed portion 1014, the heat of the heating wire of the evaporator 340 is used for defrosting, the blockage of the drain hole 103 by an ice block is avoided, and additional addition of a heating wire at the drain hole 103 is not needed.

By using the structure of the recessed portion 1014, parts of regions of the inclined evaporator 340 may be suspended to facilitate defrosting and water drainage. Since the evaporator 340 is inclinedly disposed, the distance between the evaporator 340 and the drain hole 103 may be reduced, which not only improves the space utilization of the refrigerator, but also ensures that the heating wire on the evaporator 340 can heat the region at the drain hole 103, so that the frosting risk at the drain hole 103 can be reduced.

The inclination angle of the second inclination portion 1012 can also facilitate gathering of water to the drain hole 103, thus improving the water drainage smoothness. A proportion of a portion of the evaporator 340 attached to the second inclination portion 1012 to the bottom surface of the evaporator 340 is greater than or equal to 0.6, and for example, may be set to be ⅔, ¾, etc., so that the drain hole 103 is located below the front portion of the evaporator 340. That is, the position of the drain hole 103 along the front and rear direction of the refrigerator body 100 is located at the front portion of the evaporator 340, for example, the drain hole 103 may be located below a ⅓ (or ¼) position of the integral depth size of the evaporator 340.

According to the refrigerator of the present embodiment, by ensuring the attaching length of the bottom surface of the evaporator 340 to the second inclination portion 1012, the condition that air does not flow into the evaporator 340 but flows through a space between the bottom surface of the evaporator 340 and the drain hole 103 is avoided, a length of a flowing path of the air through the evaporator 340 is increased, and the heat exchange efficiency of the evaporator 340 is further improved.

Through the structure of the cooling compartment 110 and inclined arrangement of components of the evaporator 340, etc., the smooth and sufficient heat exchange of the airflow is ensured, frosting is reduced to a certain degree, and the defrosting and water drainage efficiency is improved.

The air supply assembly 400 of the refrigerator of the present embodiment is disposed behind the evaporator 340. The air supply assembly 400 may include the refrigeration fan 410 and the air supply duct 420. The refrigeration fan 410 is inclinedly disposed behind the evaporator 340, a suction inlet of the refrigeration fan 410 faces a front upper side, and the refrigeration fan is configured to form a refrigeration airflow sent to the storage space 120 via the evaporator 340. The refrigeration fan 410 may be a centrifugal fan. The refrigeration fan 410 is disposed inclinedly upward behind the evaporator 340 from front to back, and includes a volute and an impeller disposed in the volute. The volute is fixed to the upper side of the third inclination portion 1013. A suction inlet of the volute faces the front upper side to suck air undergone heat exchange through the evaporator 340 by utilizing the impeller. An exhaust outlet of the volute is located at a rear side. The air supply duct 420 is connected with the exhaust outlet, extends upward, and is configured to upward guide the refrigeration airflow to the storage space 120. The suction inlet of the refrigeration fan 410 is generally located in the center of the volute, and the height of the suction inlet may be higher than the top end of the evaporator 340. The refrigeration fan 410 is disposed on the third inclination portion 1013, and keeps an inclination angle consistent with that of the third inclination portion 1013 with respect to the horizontal plane. The inclination angle β of the refrigeration fan 410 may also ranges from 36.0° to 37.0°, for example, may be set to be 36.5°, 36.7° or 36.9°, and is preferably 36.7°. The volute is formed by a lower case body and an upper cover body through buckling, which facilitates the disassembly and assembly of the volute.

The exhaust outlet of the refrigeration fan 410 is located at the rear side, and is configured to supply air to an inclined rear side. The air supply duct 420 communicates with the exhaust outlet of the refrigeration fan 410, extends upward, and is configured to convey the refrigeration airflow to the storage space 120. An air supply port 421 communicating with the air supply duct 420 is formed in a rear wall of the storage space 120, to exhaust the refrigeration airflow into the storage space 120. A proportion of a thickness of an upward extending vertical section of the air supply duct 420 along the front and rear direction to the depth size of the refrigerator body 100 along the front and rear direction is smaller than 5.0%, and for example, may be 4.9%.

A foaming layer of the refrigerator body 100 is disposed at the outer side of the cooling compartment 110 and the storage space 120, that is, located at the outer side of the bottom inner liner 101, and surrounds the bottom inner liner 101. Additionally, a proportion of the thickness of the foaming layer at the back portion of the storage space 120 to the depth size of the refrigerator body 100 along the front and rear direction is smaller than 11.2%, and for example, may be set to be 11%. There is a conflict between the thickness of the foaming layer and the heat insulation performance. The thickness of the foaming layer is set through structure optimization made according to space requirements and heat insulation requirements, and the effect is verified through trial products.

The evaporator upper cover 130 is transversely disposed in the bottom inner liner 101, and is configured to separate the cooling compartment 110 from the storage space 120. An air return cover 131 is disposed at a front end of the evaporator upper cover 130, and is used as a front wall of the cooling compartment 110. A proportion of a horizontal distance from a front end of the air return cover 131 to the front end of the refrigerator body 100 to the depth size of the refrigerator body 100 along the front and rear direction is smaller than 4.9%, and for example, may be set to be 4.7%. The air return cover 131 is provided with a front air return inlet 132 communicating with the storage space 120 at the front side of the cooling compartment 110, so that an air return airflow of the storage space 120 enters the cooling compartment 110 through the front air return inlet 132 to perform heat exchange with the evaporator 340 and complete airflow circulation between the cooling compartment 110 and the storage space 120. The distance from the front end of the air return cover 131 to the front end of the refrigerator body 100 is set through structure optimization made according to space requirements and air return performance requirements, and the effect is verified through trial products.

The evaporator upper cover 130 includes a first upper cover portion 1301, the first upper cover portion 1301 is located at a top portion of the evaporator 340 and is basically horizontally disposed, and the height of the first upper cover portion 1301 with respect to the bottom surface of the refrigerator body 100 may be set to be smaller than or equal to 200 mm, and for example, is 199 mm. The volume of the storage space 120 is enabled not to change under the condition of reducing the depth size of the cooling compartment 110, and the utilization rate of the storage space 120 is improved. The setting of the height of the first upper cover portion 1301 with respect to the bottom surface of the refrigerator body 100 is set through structure optimization made according to space requirements, and the effect is verified through trial products. The height of the first upper cover portion 1301 with respect to the ground is reduced to 223.5 mm, which also increases the effective utilization rate of the storage space 120.

A gap space between the first upper cover portion 1301 and the evaporator 340 is filled with a heat insulation material. A space between the top of the front end of the evaporator 340 to the first upper cover portion 1301 may be set to be smaller than or equal to 36 mm, and for example, is 36 mm. A minimum space from the evaporator 340 to the first upper cover portion 1301 may be set to be smaller than or equal to 15 mm, and for example, is 15 mm. A thickest portion of the heat insulation material may be 36 mm, and a thinnest portion thereof may be 15 mm. On the premise of ensuring the heat insulation and thermal preservation performance, the thickness of the heat insulation material is compressed to the thinnest. The distance from the evaporator 340 to the first upper cover portion 1301 and the space from the front end of the evaporator 340 to the first upper cover portion 1301 are set through structure optimization made according to space requirements and heat insulation and thermal preservation performance requirements, and the effect is verified through trial products.

The evaporator upper cover 130 further includes a second upper cover portion 1302 formed by extending inclinedly upward from a rear end of the first upper cover portion 1301. The second upper cover portion 1302 is located above the refrigeration fan 410, and an inclination angle thereof may be set to be consistent with the inclination angle of the refrigeration fan 410. A space between the refrigeration fan 410 and the second upper cover portion 1302 is set to be smaller than or equal to 30 mm, and for example, may be set to be 30 mm. The height of the second upper cover portion 1302 may be set to be smaller than or equal to 93 mm, and for example, set to be 93 mm, so that the refrigeration performance of the refrigerator is not influenced while an air suction space of the refrigeration fan 410 is ensured. The setting of the space between the refrigeration fan 410 and the second upper cover portion 1302 and the setting of the height of the second upper cover portion 1302 are set through structure optimization made according to space requirements and refrigeration performance requirements, and the effect is verified through trial products.

The two front air return inlets 132 in vertical distribution are formed at the front side of the air return cover 131, the appearance is attractive, and children's fingers or foreign articles can be effectively prevented from entering a cooling space. Additionally, through two vertically distributed air return regions, return air more uniformly flows through the evaporator 340 after entering the cooling space, the problem of easy frosting at the front end surface of the evaporator 340 can be avoided to a certain degree, the heat exchange efficiency can be improved, the defrosting period can be prolonged, the energy is saved, and the efficiency is high. Through structure detail features of each inclination section of the air return cover 131, condensed water formed on the air return cover 131 can be guided to facilitate water drainage, the water dripping sound that can be sensed by human ears can be avoided, and the use experience of users is improved.

There may be two air return covers 131 distributed at the left and right along a transverse direction and separated by the longitudinal separation plate 140. The longitudinal separation plate 140 is disposed in the middle portion of the storage space 120 and separates the storage space 120 into two transversely arranged storage cavities. Each storage cavity is provided with one air return cover 131. A heat insulation vertical beam 141 is disposed in front of the longitudinal separation plate 140. The heat insulation vertical beam 141 is configured to cooperate with the door body of the storage cavity for avoiding the cold from being leaked from the edge of the door body.

A proportion of the thickness of a heat insulation layer of the heat insulation vertical beam 141 along the front and rear direction to the depth size of the refrigerator body 100 along the front and rear direction is smaller than 8.4%, and a proportion of a horizontal distance from the front end of the evaporator 340 to the heat insulation vertical beam 141 to the depth size of the refrigerator body 100 in the front and rear direction is smaller than 7.7%. The thickness of the heat insulation layer of the heat insulation vertical beam 141 and the position of the heat insulation vertical beam with respect to the evaporator 340 are set through structure optimization made according to space requirements and heat insulation performance requirements, and the effect is verified through trial products.

Figure 8:
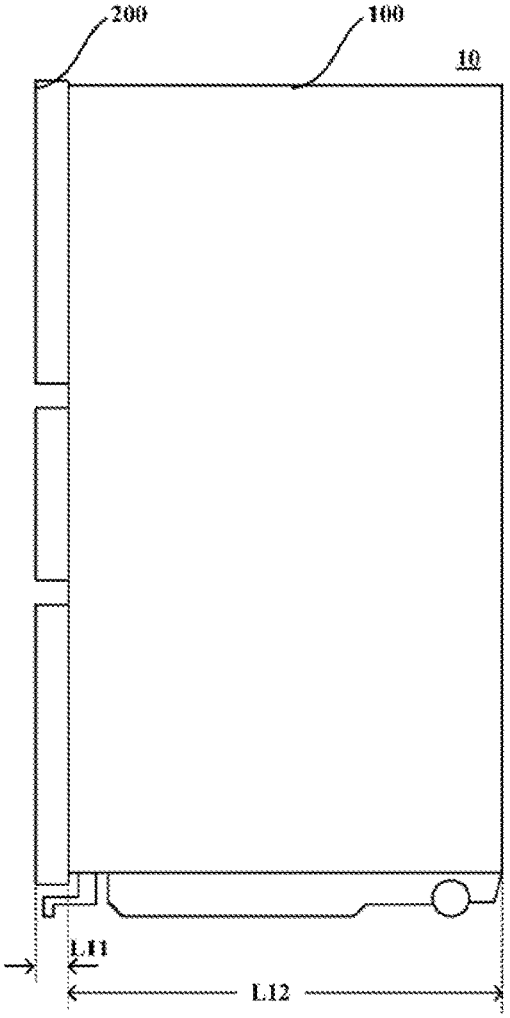
FIG. 8 is a schematic structure diagram after a door body of a refrigerator according to an embodiment of the present invention is closed.

Additionally, in order that the integral depth size of the refrigerator meets the requirements, the thickness of the door body may be set to be smaller than or equal to 62 mm. FIG. 8 is a schematic structure diagram after a door body 200 of a refrigerator 10 according to an embodiment of the present invention is closed. After the door body 200 is closed to seal the storage space 120, the integral depth size (integral thickness of the front and rear direction) of the refrigerator 10 may be smaller than or equal to 572 mm, so that the size requirement matched with a cupboard is met.

A specific embodiment of a refrigerator with the depth size of a refrigerator body 100 being 510 mm will be illustrated in conjunction with the sizes provided in FIGS. 1, 4, 5, 6 and 8 hereafter. The volume of the refrigerator body of the refrigerator 10 may be the same as that of a conventional 550 mm refrigerator body, and the space utilization efficiency is sufficiently achieved.

The integral depth size L12 of the refrigerator body 100 is 510 mm, and a thickness L11 of a door body 200 is set to be 62 mm. Therefore, the integral thickness of the refrigerator is only 572 mm. A bottom-mounted refrigeration module includes an evaporator upper cover 130, an evaporator 340, a refrigeration fan 410, a compressor compartment 150 and apparatuses in a compartment body of the compressor compartment 150. A height H1 of the whole of the bottom-mounted refrigeration module with respect to the ground is 316.1 mm, and a height H4 of the bottom surface of the refrigerator body 100 with respect to the ground is 24.5 mm, so that the integral height of the bottom-mounted refrigeration module is only 291.6 mm.

A depth size L9 of the evaporator 340 in the refrigerator 10 is 152 mm, a longitudinal size L10 thereof is 75 mm, a left and right transverse size (not shown) thereof is 470 mm, and a longitudinal height H7 thereof is 75 mm. An inclination angle α of the evaporator 340 with respect to the horizontal plane may be 7.5°. An inclination angle of a bottom wall portion of a bottom inner liner 101 for supporting the evaporator 340 with respect to the horizontal plane is correspondingly set to be 7.5°.

Due to inclined arrangement of the evaporator 340, the length L3 of the horizontal direction projection of the evaporator along the front and rear direction is 162 mm. Although the length in the front and rear direction is increased, due to the inclined arrangement of the evaporator, the arrangement of other components in the cooling compartment 110 is more reasonable. Through practical airflow flow field analysis, it is proved that the air circulation efficiency is higher, and the water drainage is smoother. At the same time, the inclined arrangement of the evaporator 340 can also prevent the blockage of an air return port due to frosting caused by too short distance from the evaporator 340 to a heat insulation vertical beam 141.

The refrigeration fan 410 is also inclinedly disposed. An inclination angle β of the refrigeration fan 410 with respect to the horizontal plane may be 36.7°, and an inclination angle of a bottom wall portion of the bottom inner liner 101 for supporting the refrigeration fan 410 with respect to the horizontal plane is also correspondingly set to be 36.7°.

From front to back, the sizes and relative relationships of each component in the cooling compartment 110 and a storage space 120 are as follows: a horizontal distance L8 from a front end of an air return cover 131 to a front end of the refrigerator body 100 is 24 mm. A thickness L1 of a heat insulation layer of the heat insulation vertical beam 141 along the front and rear direction is set to be 42 mm. A distance L9 from a front side surface to a rear side surface of the evaporator 340 is 152 mm, and a distance L10 from a top surface to a bottom surface of the evaporator is 75 mm. A horizontal distance L4 from the front end of the refrigeration fan 410 to the evaporator 340 is 22 mm to reduce a depth distance between the evaporator 340 and the fan 410 to a maximum degree under the condition of ensuring no frosting of blades of the refrigeration fan 410. A thickness L6 of an upward extending vertical section of the air supply duct 420 along the front and rear direction is 25 mm, and therefore, a length L5 of a horizontal direction projection of an air supply assembly along the front and rear direction may be ensured to be 200 mm. A thickness L7 of the foaming layer at the back portion of the storage space 120 is 56 mm. A thickness L13 of the foaming layer at two sides of the storage space 120 is 65 mm.

Correspondingly, it can be obtained that L8 is 4.7% of L12, L6 is 4.9% of L12, L1 is 8.2% of L12, L2 is 7.5% of L12, L3 is 29.8% of L12, L4 is 4.3% of L12, L5 is 39.2% of L12, L7 is 11% of L12, and L9 is 49.3% of L10. The above sizes, relative positions and proportion relationships are all completed on the basis of rigorous demonstration and precise calculation. Under the condition of very rigorous size requirements, various performance index requirements are met. The sizes and the relative positions are mutually matched to jointly achieve corresponding functions. The change of any one of the above sizes and relative positions may cause a condition that the performance of the refrigerator 10 in an aspect cannot meet the requirement or even the function cannot be achieved.

From top to bottom, the height and relative relationship of each component in the cooling compartment 110 and the storage space 120 are set as follows: a height H1 of the whole of the bottom-mounted refrigeration module with respect to the ground is 316.1 mm. A height H10 of the second upper cover portion 1302 of the evaporator upper cover 130 is 93 mm. A height H2 of the first upper cover portion 1301 with respect to the ground is 233.5 mm. The space H8 from the first upper cover portion 1301 to the top of the front end of the evaporator 340 is 36 mm. A height H3 of the first upper cover portion 1301 with respect to the bottom surface of the refrigerator body 100 is 199 mm. The minimum space H9 between the evaporator 340 and the evaporator upper cover 130 is 15 mm. A height H6 from the position of the evaporator 340 abutted against the first inclination portion 1011 to the drain hole 103 is 22 mm. A height H5 of the drain hole 103 with respect to the bottom surface of the refrigerator body 100 is 66 mm. The above sizes and relative positions are all completed on the basis of rigorous demonstration and precise calculation. Under the condition of very rigorous size requirements, various performance index requirements are met. The sizes and the relative positions are mutually matched to jointly achieve corresponding functions. The change of any one of the above sizes and relative positions may cause a condition that the performance of the refrigerator 10 in an aspect cannot meet the requirement or even the function cannot be achieved.

So far, those skilled in the art should recognize that although multiple exemplary embodiments of the present invention have been exhaustively shown and described herein, many other variations or modifications in accordance with the principles of the present invention may still be directly determined or derived from the disclosure of the present invention without departing from the spirit and scope of the present invention. Therefore, the scope of the present invention should be understood and interpreted to cover all such other variations or modifications.

What is claimed is:

1. A refrigerator having an evaporator disposed at the bottom of a refrigerator body, comprising:

the refrigerator body, having a bottom inner liner, the bottom inner liner defining a cooling compartment and a storage space, and the cooling compartment being disposed below the storage space; and the evaporator, arranged in the cooling compartment and placed inclinedly along the depth direction of the refrigerator with respect to the horizontal direction, with the direction of inclination being upward from front to back;

wherein a bottom wall of the bottom inner liner comprises:

a plane-shaped first inclination portion, disposed inclinedly downward from a front end of the bottom wall of the bottom inner liner from front to back;

a recessed portion, disposed at a rear side of the first inclination portion and configured to be inclined upward from a transverse middle to two sides along a transverse direction of the refrigerator to form a drain hole in the transverse middle, both side surfaces of the recessed portion along the transverse direction and both side surfaces of the recessed portion along the depth direction of the refrigerator being inclined-plane-shaped, and the drain hole being configured to drain water from the cooling compartment; and a plane-shaped second inclination portion, disposed inclinedly upward from a rear end of the recessed portion from front to back and configured to support the evaporator, an inclination angle of the evaporator being consistent with that of the second inclination portion with respect to a horizontal plane, and a front end of the evaporator abutting against the first inclination portion so that water on the evaporator is gathered at the recessed portion, and a position of the drain hole along the front and rear direction of the refrigerator body being at a front portion of the evaporator;

wherein the recessed portion provided with the drain hole is formed in a connecting position of the first inclination portion and the second inclination portion, so that the drain hole is used to drain condensed water of the evaporator;

wherein the bottom wall of the bottom inner liner further comprises:

a plane-shaped third inclination portion, disposed inclinedly upward from a rear end of the second inclination portion from front to back and having an inclination angle greater than that of the second inclination portion;

wherein the refrigerator further comprises a refrigeration fan, disposed on the third inclination portion and configured to promote formation of a refrigeration airflow sent to the storage space via the evaporator;

wherein the refrigeration fan is a centrifugal fan which comprises a volute and an impeller disposed in the volute, the volute is fixed to the third inclination portion with a bottom face of the volute, opposite to a suction inlet of the volute, being parallel to the third inclination portion, and the suction inlet of the volute faces a front upper side to suck air undergone heat exchange through the evaporator by utilizing the impeller.

2. The refrigerator according to claim 1, wherein an inclination angle of the evaporator with respect to the horizontal direction ranges from 7.0° to 8.0°.

3. The refrigerator according to claim 2, wherein the evaporator is generally in the shape of a flat cuboid, and a proportion of a distance between a front side surface and a rear side surface of the evaporator to a distance between a top surface and a bottom surface of the evaporator ranges from 1.9 to 2.1.

4. The evaporator according to claim 3, wherein the distance between the front side surface and the rear side surface of the evaporator ranges from 150 mm to 155 mm; and the distance between the top surface and the bottom surface of the evaporator ranges from 73 mm to 78 mm.

5. The refrigerator according to claim 1, wherein the refrigerator further comprises:

an air supply duct, disposed at a downstream of an air supply direction of the refrigeration fan and configured to convey the refrigeration airflow to the storage space.

6. The refrigerator according to claim 5, wherein an exhaust outlet of the volute is located at a rear side, and the air supply duct is connected with the exhaust outlet, extends upward and is configured to upward guide the refrigeration airflow to the storage space.

7. The refrigerator according to claim 6, wherein the refrigerator body further comprises:

an evaporator upper cover, transversely disposed in the bottom inner liner and used to separate the cooling compartment from the storage space, the evaporator upper cover comprising:

a first upper cover portion, located at the top of the evaporator and basically horizontally disposed; and a second upper cover portion, extending inclinedly upward from a rear end of the first upper cover portion and disposed in a manner of being parallel to the centrifugal fan and forming a set distance from the centrifugal fan; and air sucked by the centrifugal fan enters the suction inlet through a gap between the centrifugal fan and the second upper cover portion.

8. The refrigerator according to claim 7, wherein a space between the centrifugal fan and the second upper cover portion is smaller than or equal to 30 mm.

9. The refrigerator according to claim 5, wherein an inclination angle of the third inclination portion with respect to the horizontal direction ranges from 36.0° to 37.0°.

10. The refrigerator according to claim 5, wherein an inclination angle of the refrigeration fan is consistent with that of the third inclination portion with respect to the horizontal plane.

11. The refrigerator according to claim 6, wherein the suction inlet of the refrigeration fan is located at a position higher than a top end of the evaporator.

12. The refrigerator according to claim 1, wherein a height from the position of the evaporator abutted against the first inclination portion to the drain hole is smaller than or equal to 22 mm.

* * * * *